United States Patent [19]

Fisher et al.

[11] 3,989,107

[45] Nov. 2, 1976

[54] INDUCTION HEATING OF UNDERGROUND HYDROCARBON DEPOSITS

[76] Inventors: Sidney T. Fisher, 53 Morrison Ave.; Charles B. Fisher, 2850 Hill Park Road, both of Montreal, Quebec, Canada

[22] Filed: Mar. 10, 1975

[21] Appl. No.: 556,545

[52] U.S. Cl. ..... 166/248; 166/302; 266/287

[51] Int. Cl.[2] ..... E21B 43/24; E21B 43/25

[58] Field of Search ..... 166/302, 60, 248; 299/4, 5, 6, 14; 75/29, 133; 219/10.41, 10.57; 266/1 R, 5 EI, 129, 149, 287

[56] References Cited

UNITED STATES PATENTS

| | | | |
|---|---|---|---|
| 1,286,394 | 12/1918 | Northrup | 266/5 EI |
| 1,291,302 | 1/1919 | Waring | 166/302 |
| 1,510,655 | 10/1924 | Clark | 166/60 X |
| 2,256,901 | 12/1941 | Hörgard | 75/133 X |
| 2,472,445 | 6/1949 | Sprong | 166/60 |
| 2,634,961 | 4/1953 | Ljungstrom | 166/302 |
| 2,732,195 | 1/1956 | Ljungstrom | 166/302 |
| 2,859,952 | 11/1958 | Tour et al. | 219/10.57 |
| 2,923,535 | 2/1960 | Ljungstrom | 166/302 X |
| 3,472,987 | 10/1969 | Viart | 219/10.41 |
| 3,727,982 | 4/1973 | Itoh et al. | 299/14 |

OTHER PUBLICATIONS

"AC Current Heats Heavy Oil for Extra Recovery," *World Oil* May 1970, pp. 83–86.

*Primary Examiner*—Stephen J. Novosad
*Assistant Examiner*—George A. Suckfield
*Attorney, Agent, or Firm*—Barrigar & Oyen

[57] ABSTRACT

The electric induction heating in situ of a selected portion of an underground deposit of hydrocarbons (such as petroleum, especially petroleum entrapped within a sand formation or the like, or lignite), for the purpose of facilitating extraction of hydrocarbons from the deposit. The heating is conveniently effected by passing alternating current through a conductor encompassing the selected portion. The conductive path is preferably a toroid, helix, or simulated toroid or helix, created by drilling and passing one or more conductors through the drill holes.

9 Claims, 5 Drawing Figures

INDUCTION HEATING OF UNDERGROUND HYDROCARBON DEPOSITS

FIELD TO WHICH THE INVENTION RELATES

The present invention relates to a method of heating an underground deposit of naturally occurring hydrocarbons, such as petroleum entrapped within a deposit of sand or the like.

BACKGROUND OF THE INVENTION

In northern Alberta are located what are popularly known as "tar sands" (and which probably would be more appropriately referred to as "bituminous sands") occasionally exposed at the surface of the ground but generally overlaid by soil to varying depths. The bituminous sands comprise a heavy percentage of quartz sand (say 80%), small amounts of clay, of the order of 5% water, and of the order of 15% (frequently less) bitumen by weight. The bituminous sand deposits are estimated to contain more than one million million barrels of oil.

For many years efforts have been made to recover the oil, and several processes have been proposed for the purpose. Many proposals have involved the mining of the sand and the extraction of the petroleum from the sand thereafter. The mining techniques and associated extraction techniques have generally involved intolerably high capital investments, energy expenditures, ecological damage, and extraction and refining costs.

Various methods have been proposed to extract the petroleum from the sands in situ without requiring the mining of the sands. Recognizing that most recoverable petroleum deposits have been located at much greater depths and therefore at higher temperatures and pressures than are to be found in the Alberta bituminous sands, engineers have proposed the artificial creation of similar conditions in the bituminous sands of Alberta. Alternating current applied across terminals embedded in a bituminous sand deposit for the purpose of the heating of a portion of the bituminous sand deposit by electrical conduction has not been successful, usually because of the formation of carbonized paths between the electrodes, limiting current flow to these paths. Since the thermal conductivity of the deposits is relatively low, the heating of paths of relatively small dimensions within a bituminous sand deposit has not been successful in raising the overall temperature of the deposit (or a sufficiently large volume thereof) to the desired value.

It has also been proposed to extract petroleum from underground bituminous sand deposits by forcing steam into the deposits. The use of steam has required the generation at the surface of large amounts of process heat, and the problem exists that the steam cannot always be sufficiently confined to the particular portion of the deposit from which the petroleum is intended to be extracted but rather tends to blow out of the deposit being treated. As much as half a ton of steam has been required per barrel of oil recovered.

It has also been proposed to burn a portion of the petroleum in situ so as to generate sufficient heat to raise the temperature of the remaining portion of the petroleum sufficiently to enable the petroleum to flow into suitable wells from which the petroleum may be extracted. Such methods have been unsatisfactory to date, and even if practicable would tend to waste a good deal of the stored energy of the underground petroleum through the burning process.

Nuclear explosions have been advocated, but have not yet been experimentally tested, to realize much the same objective of increasing the heat and pressure within the underground deposit so as to enable at least a portion to be recovered. It is apparent however that at least some of the petroleum would be carbonized by a nuclear explosion, and a significant portion or perhaps all of the petroleum that could be recovered in such a process (if the process were practicable at all) would be contaminated by radioactivity.

SUMMARY OF THE INVENTION

The present inventors have recognized that some extraction techniques for recovery of oil from bituminous sands and the like would be much more satisfactory if there were a satisfactory method of heating a sufficiently large volume of the bituminous sands in situ, without undue consumption or destruction (as by burning, carbonizing, etc.) of the petroleum entrapped within the sands. The present invention accordingly has as its principal object the provision of a method of heating a selected portion of a hydrocarbon deposit in situ without appreciable combustion in situ of the constituent hydrocarbons, within the limits imposed by the nature of the constituents of the deposit, the surrounding environment, and the equipment used.

The present invention is the electric induction heating of a selected portion of an underground deposit of naturally occurring hydrocarbons, especially a petroleum deposit entrapped within a deposit of sand or the like. (In this specification, "hydrocarbon" means one or more constituents of petroleum, lignite, or other naturally-occurring underground deposits, some of which are entrapped within deposits of other materials (e.g. sand), and which are composed of the elements hydrogen and carbon sometimes with the addition of other elements.) Electric induction heating of the selected portion of the underground deposit may be effected by passing alternating electric current through an underground conductor or plurality of conductors whose path or paths are chosen to substantially encompass the volume of the hydrocarbon deposit intended to be treated. By "substantially encompassing" is meant the surrounding of the volume by the conductive path so as to generate, when alternating current is passed therethrough, an electromagnetic field sufficiently strong throughout at least a substantial portion of the encompassed volume to enable it to be heated satisfactorily by induction to a desired temperature sufficiently high to facilitate extraction of the hydrocarbons. If the location and shape of the conductive path are appropriately chosen, heat will be generated within substantially the entire mass of the encompassed volume of the deposit, and thus the temperature of substantially the entire mass of the deposit portion being treated can eventually be raised to a level sufficient to enable the hydrocarbons to be extracted (e.g. from artificially-created wells).

Problems arising from serious non-uniformity of the heating process, hitherto associated with the forced steam processes and the electric conduction processes, may be avoided, because the electric induction process of the present invention makes use of the properties of the mass being heated. Typically, a bituminous sand deposit comprises individual quartz sand particles covered by a film of water between which are interstices filled by the petroleum (together with suspensions of clay and other impurities). Both the bitumen and the quartz particles surrounded by the water film are individually susceptible to absorption of energy from the applied electromagnetic field within that portion of the deposit encompassed by the conductive path. Thus, when alternating current is passed through the conductor, the temperature of the entire heated mass tends to be raised progressively within the volume encompassed by the current path. Some local carbonization may conceivably occur immediately adjacent the conductor, but the effect is insignificant in the overall process.

Once the temperature of the underground hydrocarbon deposit has reached the desired level, the hydrocarbons may then be extracted using extraction technology already known or yet to be developed. The present invention, however, is not directed to the extraction process which follows the heating of the underground deposit; the present invention is confined to the induction heating technique per se, which will then be followed or accompanied by a suitable extraction process. (It is contemplated that the heating by induction may continue during at least some portion of the time required for extraction of the petroleum.)

Drilling techniques are known whereby other than straight vertical drill holes may be formed in the earth. Such known drilling techniques may be utilized to create an appropriate underground path for one or more conductors used to carry the alternating current to effect the induction heating of a portion of an underground petroleum deposit substantially encompassed by the conductor or conductors. In many conventional electric induction heating applications, a helical coil or wire is used, and the contents of the volume substantially encompassed by the helix are then heated by induction for the particular purpose which the designer has in mind. (Ideally, a toroid-shaped conductor coil configuration would be utilized, since a toroid avoids the end losses associated with a helix.) To avoid the difficulty and expense of drilling continuously curved paths, it is possible to simulate a helical path underground by means of interconnected straight-line drill holes at appropriate angles to the vertical and meeting the surface at various preselected points, through which drilled passages a conductor or plurality of conductors may be fed and joined together by conventional techniques so as to create a continuous conductive path which will surround an economically significant volume of a selected underground petroleum deposit. Alternating current caused to flow through this conductive path will then heat by induction the mass of materials located within the volume substantially encompassed by the conductive path.

The voltage, current, frequency and waveform of the alternating current and the time during which it is applied are selected to raise the temperature of the mass substantially encompassed by the conductive path to a desired temperature sufficient to improve the capability of the petroleum to gasify or vaporize or to flow into suitable collecting wells or other regions from which extraction may occur in a subsequent stage of the petroleum recovery process.

Although the present invention has been conceived with the primary intention of its exploitation in the recovery of petroleum from the bituminous sands of Alberta, the invention may have utility in other applications. In Colorado and other areas of the United States, there are large beds of oil shale. These oil shale deposits are sometimes exposed at the surface but generally are overlaid by other formations. Kerogen is entrapped within the oil shales. The present invention should be successful, when applied to these oil shales, in raising the temperature of the entrapped kerogen progressively within a particular portion of the shale heated by induction in accordance with techniques essentially similar to that described above with reference to the bituminous sands of Alberta.

Furthermore, there are many liquid petroleum wells in North America and elsewhere which have been exhausted by conventional methods. In these wells, as much as perhaps 70% of the original petroleum deposits remain underground. A significant portion, perhaps half of the underground petroleum residues cannot be economically recovered by present techniques. The induction heating technique of the present invention may possibly be utilized in association with such "exhausted" liquid petroleum oil wells to raise the temperature of the residual underground petroleum deposits. The raising of the temperature of these deposits would be expected to promote gasification, vaporization or increased petroleum flow, with the possible result that further recovery of petroleum from such wells could be economically realized.

Finally, in many parts of North America and elsewhere may be found substantial underground lignite deposits. Many of these are commercially unworkable, sometimes because of the serious risk of explosion of associated oil and gas deposits. If the lignite deposits could be gasified, vaporized or liquefied, extraction of the constituent hydrocarbons by means of techniques heretofore utilized for oil and gas extraction could be realized. It will be apparent that the present invention provides a potentially useful method for heating underground lignite deposits to the required temperatures for facilitation of such extraction.

DETAILED DESCRIPTION WITH REFERENCE TO THE DRAWINGS

In the following discussion, reference for the most part will be made to bituminous sand deposits. However, those skilled in the art will recognize that the techniques discussed can be applied, mutatis mutandis, to other types of underground hydrocarbon deposits.

Figure 1:
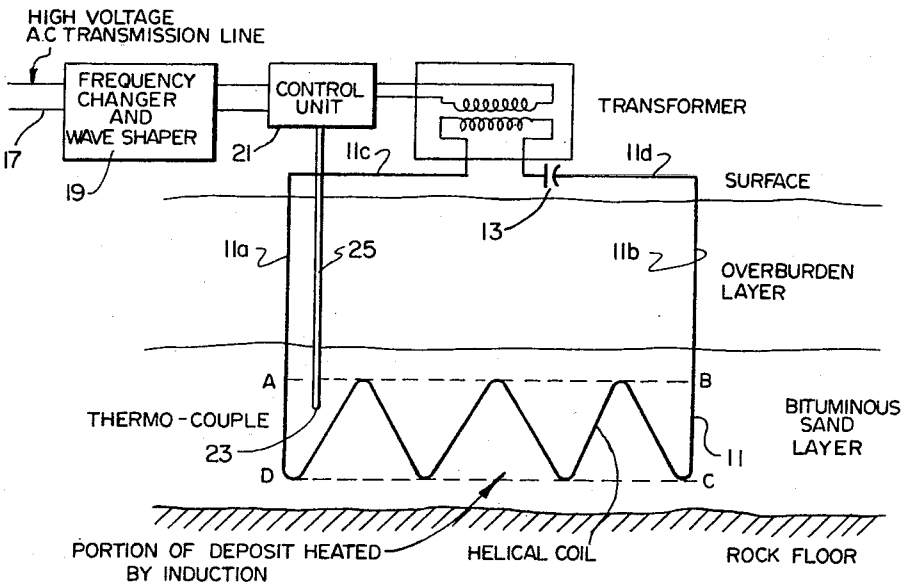
FIG. 1 is a schematic elevation view illustrating a conductive path and associated surface electrical equipment for use in the heating by induction of a selected portion of a bituminous sand deposit or the like, in accordance with the teaching of this invention.

In FIG. 1, a bituminous sand layer is shown located between an overburden layer and a rock floor. Within the bituminous sand layer, an electrical conductor 11 forms a generally helical path substantially encompassing the volume ABCD within the bituminous sand layer. (In the plan view of the same region illustrated schematically in FIG. 2, the same volume is identified by the letters ABEF.) At each end of the helix, the conductor 11 extends vertically upwards to the surface of the ground along paths 11*a*, 11*b* respectively which, when they reach the surface, extend along surface conductors 11*c*, 11*d* respectively to the secondary winding of transformer 15, which should be located as close as possible to the underground conductor in order to minimize surface ohmic losses.

The transformer 15 is a step-down transformer intended to supply a relatively low-voltage high-amperage current to the underground conductor 11. Electricity is supplied to the primary winding of transformer 15 from high voltage alternating current transmission lines 17 via frequency changer and wave shaper unit 19 and control unit 21.

A capacitor 13 is connected in series with the helical conductor 11 (which, because of its shape, has appreciable inductance) in order to resonate the conductor 11 at the frequency selected for operation.

It is expected that with experimental testing, the inductive heating effects in the bituminous sand layer will be found to be dependent upon the frequency of alternating current passed through the underground conductor, and also upon the shape of the wave form of the current (and indeed may vary with the temperature and other parameters as the underground mass is heated). For this reason, the frequency changer and wave shaper unit 19 is shown in order that alternating current of the desired frequency and wave shape may be supplied to the underground conductor 11. If, however, experimentation reveals that the frequency and wave shape of the current supplied by the high voltage alternating current transmission line 17 is satisfactory, the frequency changer and wave shaper unit 19 could be omitted and the transmission line 17 connected directly via control unit 21 to the transformer 15. (In North America it would be ordinarily expected that the AC transmission line 17 would carry current having a frequency of 60 Hz. and a sinusoidal wave form.)

Control unit 21 is intended to regulate the amount of current supplied by the transformer 15 to the underground conductor 11. It is contemplated that after an appropriate period of time, the temperature of at least a significant portion of the volume ABCD within the bituminous sand layer will progressively reach that temperature at which an improved flow of petroleum into a collecting well or the like may be expected. Accordingly, one or more thermocouples 23 suitably located within the volume ABCD and connected by conductive wires 25 to the control unit 21 sense the temperature of the bituminous sand layer generally encompassed by the underground conductor 11. The control unit 21 in its simplest form may be a temperature-responsive switch which closes when the temperature sensed by thermocouple 23 falls below a predetermined low limit and which opens when the temperature sensed by the thermocouple 32 rises above a predetermined high limit.

A cylindrical helical coil configuration is frequently found in industrial induction heating apparatus because the electromagnetic field is strongest within such helix the and decreases in intensity outside the coil. Thus if the material located within the volume encompassed by the helix is relatively uniform, the induction heating energy can be expected to be transferred to substantially all the material encompassed by the coil. The above is true also of a toroidal coil, and the toroid avoids the end losses associated with a helix. If the economics of the situation warrant it, a toroid (or simulated toroid) could be used instead of a helix.

The rate of absorption of energy from the helical conductive path increases with the intensity of the electromagnetic field generated, and also increases with the conductivity of the energy-absorbing material located within the helix. The rate of absorption of energy also increases with increasing frequency, within certain limits. Because of resonance effects, there may also be an optimum frequency for energy absorption for any given conditions, which optimum frequency may conceivably vary over the duration of the heating and extraction processes.

Figure 2:
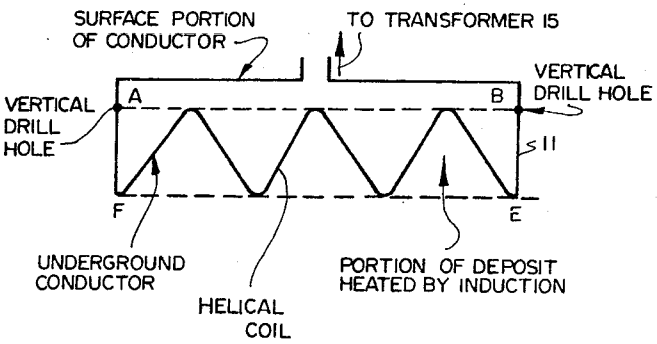
FIG. 2 is a schematic plan view of the conductive path and surface connections therefor illustrated in FIG. 1.
Figure 4:
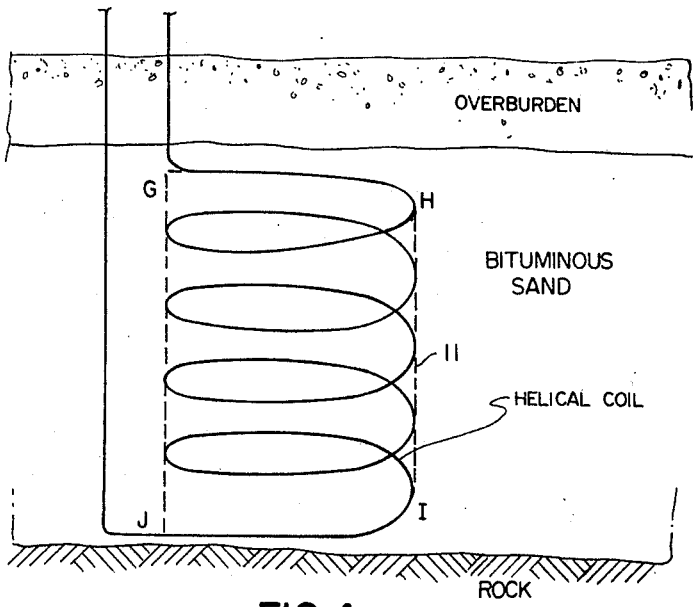
FIGS 4 and 5 are schematic perspective views of alternative underground conductive paths for the induction heating of a volume of bituminous sand or the like in accordance with the principles of the present invention.

A helix oriented in a direction perpendicular to the orientation of the helix of FIGS. 1 and 2 might perhaps be more easily formed than that of FIGS. 1 and 2; FIG. 4 illustrates such a helical path substantially encompassing and intended to heat by induction the volume GHIJ.

Figure 3:
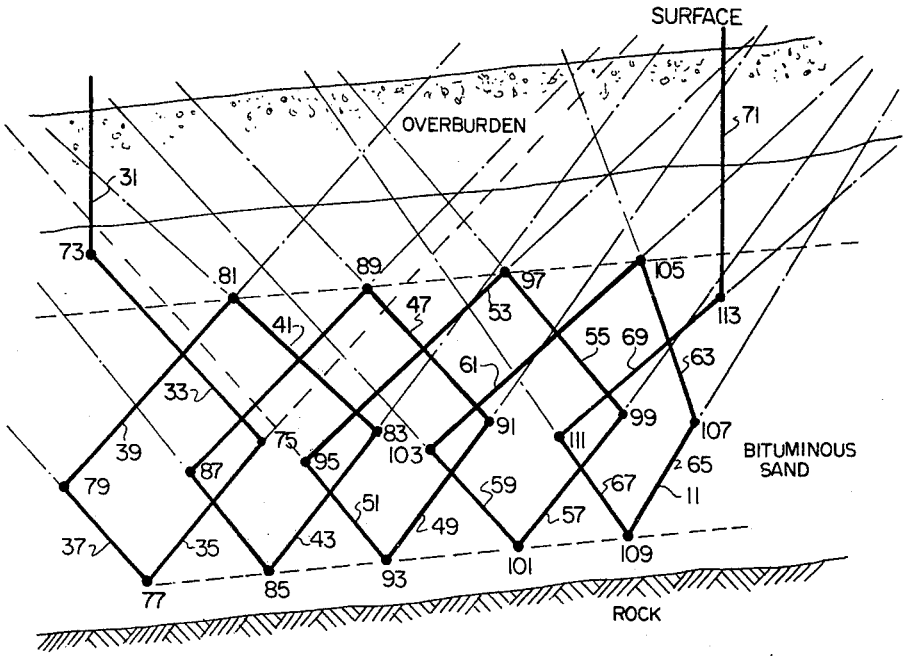
FIG. 3 is a schematic view illustrating a pattern of straight-line drill holes so located as to enable the simulation of the conductive path of FIG. 1.

In any event, the helix of FIGS. 1 and 2 may be simulated by a number of interconnected straight-line conductive paths which can be formed in the manner illustrated by FIG. 3. The conductive paths of FIG. 3 are formed in interconnected straight-line drill holes. Vertical drill holes 31 and 71 are formed. Drill holes 33, 35, 37, 39, 41, 43, 45, 47, 49, 51, 53, 55, 57, 59, 61, 63, 65, 67 and 69 are formed at appropriate angles to the surface to enable these drill holes to intersect with one another and with holes 31 and 71 at points 73, 75, 77, 79, 81, 83, 85, 87, 89, 91, 93, 95, 97, 99, 101, 103, 105, 107, 109, 111 and 113, thereby forming the simulated helical path commencing at point 73 and ending at point 113. Conductors may be located along the appropriate portions (viz., between points of intersection and between the surface and points 73, 113) of the aforementioned drill holes and interconnected at the aforementioned points of intersection so as to form a continuous conductive path beginning with vertical segment 31 and ending with vertical segment 71.

Figure 5:
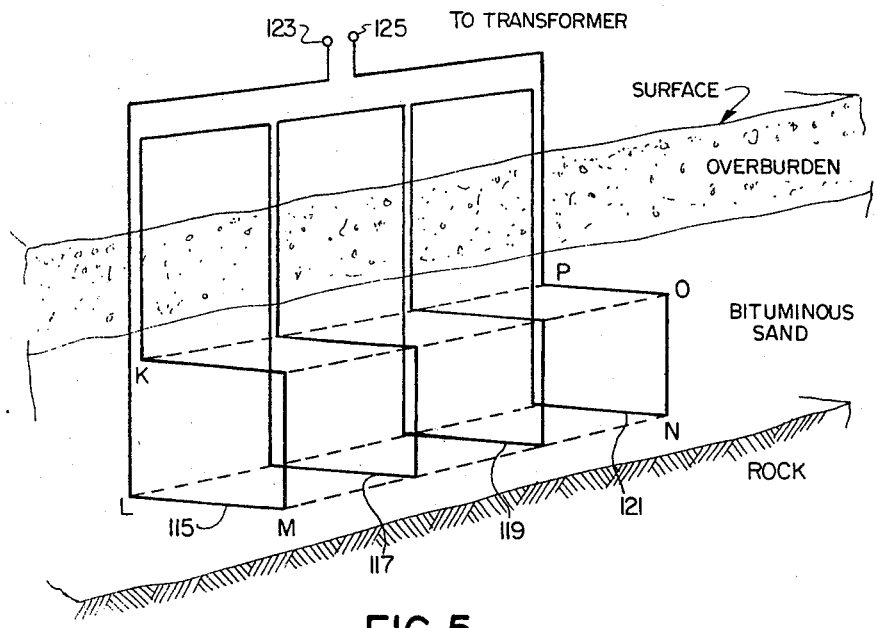

Alternatively, a series of generally rectangular conductive loops may be formed, each loop located within a plane, the planes of the loops being parallel to one another, so as to define an encompassed volume KLMNOP, as illustrated schematically in FIG. 5. These rectangular loops of course will remain open at some point, e.g. at a corner, so as to enable current to flow around the loop. The loops are then surface-connected in the manner illustrated in FIG. 5 to form a continuous circuit from surface terminal 123 to surface terminal 125. Other possible arrangements of interconnected series- or parallel-connected loops will readily occur to those skilled in the art.

The film of water (usually salt water) which typically surrounds the sand particles in many Alberta deposits contributes to the absorption of energy by the conductor-encompassed mass from the applied electromagnetic field. Howevr, as the temperature of the mass rises to the boiling point of the water, the water will tend to boil off as steam. The steam may be beneficial in generating pressure useful to enhance flow of petroleum out of the deposit.

The thermal conductively of both the overburden and rock floor defining the upper and lower limits of underground bituminous sand layers in Alberta typiclly is low in comparison with the thermal conductivity of the bituminous sand. Accordingly, heat losses from the petroleum deposits are expected to be small. Heat loss from the conductor-encompassed volume of bituminous sand will generally be in a transverse direction, to regions of the bituminous sand outside of the volume encompassed by the conductive path. These "losses" can be put to good use if the adjacent volumes of bituminous sand are also inductively heated, so that the "loss" from any one encompassed volume of bituminous sand tends to be useful in raising the temperature of an adjacent encompassed volume of bituminous sand from which petroleum is to be extracted.

Indeed, it is contemplated that an array of inductively-heated volumes of bituminous sand will be processed at any given time, and that a program of continual drilling, conductor disposal, induction heating, and petroleum extraction may expand progressively to adjacent volumes of the petroleum-bearing bituminous sand deposits.

If for any reason it is desired to maintain a particular volume of the bituminous sand at a sustained elevator temperature for a prolonged period of time, the control unit 21 may regulate the current supplied to the underground conductor 11 so as to generate only sufficient heating energy within the encompassed bituminous sand volume to compensate for the small heat losses that will occur over a period of time. It is contemplated that only a relatively small expenditure of power will be needed by reason of the low thermal conductivity of the overlying and underlying earth and rock formations.

Induction heating as described above may also be effected mutatis mutandis within oil shale formations of the type found in Colorado.

In the case of residual petroleum deposits in oil fields exhausted by conventional techniques, the existing drill holes could be utilized for the insertion of at least some of the electric cables required to form the required conductive path, and of course these same holes can be used to pump out the fluid resulting from heting the residual petroleum-bearing mass.

What is claimed is:

1. In the conditioning of a selected naturally-occurring underground hydrocarbon deposit to facilitate extraction of hydrocarbons therefrom, the improvement comprising the induction heating of a selected portion of said deposit in situ over a period of time so as to heat said portion to a temperature lying within a selected range of temperatures, the said heating being effected by means of alternating current of selected voltage, current, waveform and frequency, passed through a conductor substantially encompassing said selected portion.

2. The method of claim 1, wherein the heating is continued during extraction of hydrocarbons from the deposit.

3. The method of claim 1, wherein the deposit contains bitumen.

4. The method of claim 3, wherein the bitumen is entrapped in sand.

5. The method of claim 1, wherein the deposit contains kerogen entrapped in shale.

6. The method of claim 1, wherein the deposit contains lignite.

7. The method of claim 1, wherein the conductor forms loops or turns each of which substantially surrounds part of said selected portion.

8. the method of claim 7, wherein the path of the conductor defines a helix or toroid.

9. The method of claim 7, wherein the conductor comprises connected segments approximating a helix or toroid.

* * * * *